US006139940A

United States Patent [19]

Iwamoto et al.

[11] Patent Number: 6,139,940

[45] Date of Patent: Oct. 31, 2000

[54] INKJET RECORDING SHEET

[75] Inventors: Kiyoshi Iwamoto; Senichi Yoshizawa, both of Shizuoka, Japan

[73] Assignee: Tomoegawa Paper Co., Ltd., Tokyo, Japan

[21] Appl. No.: 09/099,130

[22] Filed: Jun. 18, 1998

[30] Foreign Application Priority Data

Jun. 26, 1997 [JP] Japan ..... 9-187795

[51] Int. Cl.[7] ..... B41M 5/00

[52] U.S. Cl. ..... 428/195; 428/211; 428/341; 428/342; 428/500; 428/521

[58] Field of Search ..... 428/195, 209, 428/211, 500, 521, 341, 342

[56] References Cited

FOREIGN PATENT DOCUMENTS 0 742 107 11/1996 European Pat. Off. .

2 175 516 12/1986 United Kingdom .

OTHER PUBLICATIONS

Sybil P. Parker, McGraw–Hill Dictionary of Science and Technical Terms, Fourth Edition, pp. 1604, 1989.

*Primary Examiner*—Bruce H. Hess
*Attorney, Agent, or Firm*—Oblon, Spivak, McClelland, Maier & Neustadt, P.C.

[57] ABSTRACT

It is an object of the present invention to provide an inkjet recording sheet which can solve the problems of conventional inkjet printing sheets which has good ink absorbing properties, storage properties causing no blocking, clearness of printed images, and excellent fixing properties; and which can provide highly fine images without blurring in full color printing; therefore, in order to accomplish the objects, the of the present invention comprises an ink absorbing layer on at least one surface of a substrate, and an ink impermeable layer comprising a hydrophobic resin on the surface of the ink absorbing layer.

10 Claims, 2 Drawing Sheets

INKJET RECORDING SHEET

BACKGROUND OF THE INVENTION

The present invention relates to a recording sheet used for a inkjet printing method, and relates in particular to an inkjet recording sheet improved so that blurring of recorded images does not occur.

Inkjet printers have characteristics such as clarity of the produced images, silent operation, ease of coloring, and the like; therefore, they are one of the most popular printing devices at the present time. In order to prevent the nozzle from with filing dried ink, ink which is difficult to dry has been used in inkjet printers. The ink which is difficult to dry in general comprises coloring agents such as pigments, and dyes; solvents such as aqueous solvents, and water-soluble solvents; additives; and the like. In particular, absorption with aqueous materials or water-soluble materials is needed for a recording sheet used in inkjet printing methods. Therefore, the recording sheet popularly comprises an ink absorbing layer on a substrate.

The ink absorbing layer comprises a mixture as a main component in which pigments, such as silica, having high water absorbing properties are mixed into water-soluble polymers such as polyvinyl alcohol; other water-soluble polymers; and additives. However, conventional recording sheets having the above compositions have problems such as ink absorbing properties being insufficient and dry properties (fixing properties) of the ink being poor.

In order to solve these problems, improving the water absorbing properties of the recording sheet by adding a large amount of pigment having high water absorbing properties such as silica to the ink absorbing layer. However, not only is the ink absorbing layer not suitable for practical use because blurring of the printed images during printing is large, but it has poor storing properties, namely blocking occurs between adjacent sheets during storage because the surface of the ink absorbing layer becomes sticky due to the absorption of moisture. In particular, recent inkjet printers tends to be used for the purpose of making full color prints, and the amount of ink used in printing to bring out the colors is large. The problem is serious.

Moreover, in order to overcome the problem of the blurring of printed images, a recording medium in which an ink absorbing layer comprises hydrophobic materials such as salt of fatty acid is suggested in Japanese Patent Application, First Application No. 62-204990. However, hydrophobic materials must be dispersed in hydrophilic resin in this method; therefore, it is difficult to provide an ink absorbing layer having uniform components. Blurring of the printed images can be slightly reduced by the ink absorbing layer. However, the ink absorbing layer has some problems in obtaining a uniform full color image.

SUMMARY OF THE INVENTION

It is therefore an object of the present invention to provide an inkjet recording sheet which can solve the above problems of conventional inkjet printing sheets; which has good ink absorbing properties, storage properties causing no blocking, clearness of printed images, and excellent fixing properties; and which can provide highly fine images without blurring in a full color printing.

In order to accomplish the above object, the present invention comprises an ink absorbing layer on at least one surface of a substrate, and an ink impermeable layer, which does not absorb ink, comprising a hydrophobic resin on the surface of the ink absorbing layer.

DESCRIPTION OF THE PREFERRED EMBODIMENTS

The ink impermeable layer 1 is formed on the ink absorbing layer 2 so as not to perfectly cover the ink absorbing layer 2 as shown in FIGS. 1 to 5. The ink impermeable layer 1 has at least one ink impermeable section. That is, the ink impermeable sections may or may not be connected to each other. In other words, the ink impermeable sections may or may not be continuous. The shape of the ink impermeable section is not limited, and may be regular or irregular.

The ink impermeable layer 1 may be, for example, in the form of a net or dots as shown in FIGS. 1 to 5. When the ink impermeable layer 1 is in the form of a net as shown in FIGS. 1, 3, and 5, the ink absorbing layer 2 is exposed through the spaces in the net. When the ink impermeable layer 1 is in the form of dots like the ink impermeable sections shown in FIGS. 2 and 4, the exposed part of the ink absorbing layer 2 is net shaped. Moreover, when the ink impermeable layer 1 is in the form of a net, the shape of the exposed ink absorbing layer 2 through the spaces in the net may be circular, quadrilateral, and the like. In addition, when the ink impermeable layer 1 is in the form of sections, the shape of the ink impermeable sections is not limited and may be circle, quadrilateral, and the like.

In particular, when the ink impermeable layer 1 comprises two or more ink impermeable sections, the intervals between the sections are smaller than the diameter of ink dots, which is the diameter of dots of ink absorbed by the recording medium by spraying. In addition, the width of the ink impermeable sections are smaller than the diameter of ink dots.

The ink impermeable layer 1 may comprises only hydrophobic resin alone, and, if necessary, it may also comprise cross-linking agents, inorganic or organic pigments, lubricants, anti-charging agents and the like.

Any resin having hydrophobic properties can be used as the hydrophobic resin contained in the ink impermeable layer 1. Examples of the hydrophobic resin include, but are not limited to acrylic resins, polyester resins, polyurethane resins, styrene-acrylic copolymer resins, styrene-butadiene copolymer resins, acrylonitrile-butadiene copolymer resins, vinyl acetate resins, vinyl chloride resins, ethylene-vinyl acetate copolymer resins, vinyl chloride-vinyl acetate copolymer resins, silicone resins, nitrocellulose resins, alkyd resins, polyvinyl butyral resins, polycarbonate resins. Among these hydrophobic resins, acrylic resins, styrene-arylic copolymer resins, styrene-butadiene copolymer resins are suitable, because an ink impermeable layer 1 comprising these resins does not lose its ink absorbility and, in particular, has excellent anti-burring effects. Moreover, an emulsion of styrene-acrylic copolymer resins or styrene-butadiene copolymer resins is most suitable, because an ink impermeable layer 1 having extremely fine sections or net can be formed on the ink absorbing layer 2.

Any material which can support the ink absorbing layer 2 and ink impermeable layer 1, and which has sufficient strength as a recording medium can be used for the substrate used in the inkjet recording sheet of the present invention. The substrate may or may not be clear. Examples of non clear substrates include, but are not limited to, cloth, wood, metal plate, paper, and materials formed by coating or laminating clear material with non-clear material.

Examples of clear substrates include, but are not limited to, films or plates comprising polymers such as polyester resins, diacetylcellulose, triacetylcellulose, acrylic resins, polycarbonate, vinyl polychloride resins, polyimides, cellophanes, celluloids, and the like; glass plates; and the like. Among these materials, the biaxial-stretch polyester films which easily adhere to each other are preferable, because an even ink absorbing layer 2 can be obtained, and excellent adhesion between the ink absorbing layer 2 and the substrate can be obtained.

In addition, polyethylene films or polyester films to which white inorganic pigment is added or which contain fine foams such that the color thereof is white; synthetic papers, or non-woven cloths can be used as a substrate. Example of the films include, milky-white polyester film obtained by adding titanium dioxide to polyester film, thereby the color thereof is made white, YUPO (trade name; marketed by OUJIYUKA GOUSEISHI Co., Ltd. ), PEACHCOAT (trade name, marketed by NISSHINBO Co., Ltd.), Crisper (trade name; marketed by TOYOBO Co., Ltd. ), and TYVEK (trade name; marketed by Du Pont). The thickness of the substrate is controlled in view of the inkjet printing devices, but is preferable in a range of 50 to 250 $\mu$m, and more preferably in a range of 75 to 200 $\mu$m when the inkjet printing sheet is used in popular printers.

The ink absorbing layer 2 according to the present invention comprises pigments and binders.

Examples of the pigments include, but are not limited to, silica, clay, mica, talc, diatomaceous earth, potassium carbonate, barium sulfate, aluminum silicate, synthesized zeolite, alumina, zinc oxide, lithopone, satin white, and the like.

Examples of binder agents include, but are not limited to, acrylic resins, polyester resins, polyurethane resins, styrene-butadiene copolymer resins, acrylonitrile-butadiene copolymer resins, polyvinyl alcohol resins, water-soluble polyvinyl acetal resins, polyvinyl butyral resins, other vinyl resins, and the like; water-soluble resin or water dispersing resins such as polyamide resins, starch oxide, casein, polyethylene oxide, polyvinyl pyrrolidone, silicone resins, denatured thereof with a functional group, denaturated thereof obtained by graft polymerization with other type of resins, and the like. Among these resins, polyvinyl alcohol resins and polyvinyl pyrrolidone are suitable. The ratio between pigments and binder contained in the ink absorbing layer 2 is preferably in a range of 40:60 to 95:5, and more preferably in a range of 50:50 to 70:30.

In order to improve the properties of the inkjet recording sheet, other materials may be contained as additives. Examples of the other materials include, but are not limited to, water resistant agents such as melamine formaldehyde resin, urea formaldehyde resin, acrylamide resin, glyoxal, zirconium ammonium carbonate; dispersants; fluorescent dyes; pH regulators; penetrants; antiseptic agents; antioxidants; ultraviolet absorbents; and the like.

Moreover, if necessary, the ink absorbing layer 2 can be formed by laminating two or more layers.

The ink absorbing layer 2 may have a glossiness. Thereby, the appearance of the inkjet recording sheet can be improved. The glossiness measured by 60 degree relative-specular glossiness test method thereof is preferable 10 or greater.

The ink absorbing layer 2 is formed by preparing the coating solution in which the aforementioned resins and the like are dispersed or dissolved in suitable solvents such as water, and coating the coating solution onto the substrate using coaters such as a roll coater, a blade coater, an air knife-coater, and a rod coater. Moreover, the ink absorbing layer 2 can also be formed by laminating the layer comprising the coating material using a hot melt coater, or a laminate coater.

The amount of the coating solution coated on the substrate when it is dried is preferable in a range of 2 to 30 g/m$^2$, and more preferable in a range of 3 to 20 g/m$^2$. When the amount of the coating solution is less than 2 g/m$^2$, desirable ink absorbing properties and fixing properties may not be obtained. In contrast, when the amount of the coating solution is more than 30 g/m$^2$, productivity may be decreased, or the cost thereof may be high.

The ink impermeable layer 1, for example, can be obtained by coating smaller than usual amounts of the material for making the ink impermeable layer 1 to the ink absorbing layer 2, that is, by coating the material for making the ink impermeable layer 1 thinner than usual. Specifically, the coated amount of the material for making the ink impermeable layer 1 when it is dried is preferably less than 1.0 g/m$^2$, and more preferably in a range of 0.2 to 0.6 g/m$^2$. The ink impermeable layer 1 can be obtained by coating the amount of material for making the ink impermeable layer 1 using coating devices such as a wire bar-coater, a roll-coater, a blade-coater, a air knife-coater, and drying. In addition, the ink impermeable layers 1 as shown in FIGS. 1 to 5 can be obtained by a screen printing method, flexographic printing method, or Gravure printing method with a net or a dot pattern.

When the coated amount is more than 1.0 g/m$^2$, the exposed area of the ink absorbing layer 2 is small; therefore, the ink absorbing properties are lost, and the fixing properties thereof may be inferior.

When the ink absorbing layer 2 according to the present invention is glossed, the glossed ink absorbing layer 2 can be obtained by treating the surface of the ink absorbing layer 2 with a calender, or by laminating the glossed layer onto the ink absorbing layer 2.

The glossed layer can comprise silica, and a binder which are used in ink absorbing layer 2. The mixing ratio between silica and the binder is preferably in a range of 100:5 to 100:50 weight %, and more preferably in a range of 100:5 to 100:30 weight %. When a glossiness of 20 or greater is desired, silica sol is preferably contained.

In order to obtained good glossiness while not reducing the properties of the ink absorbing layer 2, the thickness of the glossed layer is preferably in a range of 5 to 12 $\mu$m, and more preferably in a range of 8 to 10 $\mu$m.

For example, the glossed layer can be obtained by coating a solution comprising silica, binder resin, and the like to the films having low adhesiveness against the glossed layer such as polyester resin films, polyolefine resin films, ethylene tetrafluoride resin films, other resin films treated with silicon which can be easily peeled; laminating the obtained film to the ink absorbing layer 2 under wet conditions; drying them; and peeling the film from the glossed layer. However, the glossed layer can be formed by other processes.

In the inkjet recording sheet of the present invention, the hydrophobic or hydrophilic properties thereof can be easily controlled by changing the ratio of the area of the exposed ink absorbing layer 2 having hydrophilic properties and the area of the ink impermeable layer 1 having hydrophobic properties. Therefore, blurring of the printed images can be prevented without loosing the ink absorbing properties of the ink absorbing layer 2 by forming the ink impermeable layer 1 comprising hydrophobic resin and having the above structure.

EXPERIMENTAL EXAMPLES

The present invention will be explained in detail hereinbelow with reference to examples. In the examples, and comparative examples, all "parts" and "%" mean "parts by weight" and "% by weight" respectively.

Example 1

A coating solution having the following composition was coated onto wood free paper having a density of 90 g/M$^2$, and then dried. Thereby an ink absorbing layer 2 having a coating of 15 g/M$^2$ when dry was obtained.

| | |
|---|---|
| silica (trade name: Carplex BS 304F; marketed by Shionogi Seiyaku Co., Ltd.; average particle diameter: 5.3 $\mu$m) | 150 parts |
| polyvinyl alcohol denaturated with a carboxyl group (trade name: Gohsenol T-330; marketed by Nippon Synthetic Chemical Industry Co., Ltd.; 10% solution) | 500 parts |
| Polyvinyl pyrrolidone (trade name: PVP K-90; marketed by GAF Co., Ltd.; 10% solution) | 150 parts |

Figure 1:
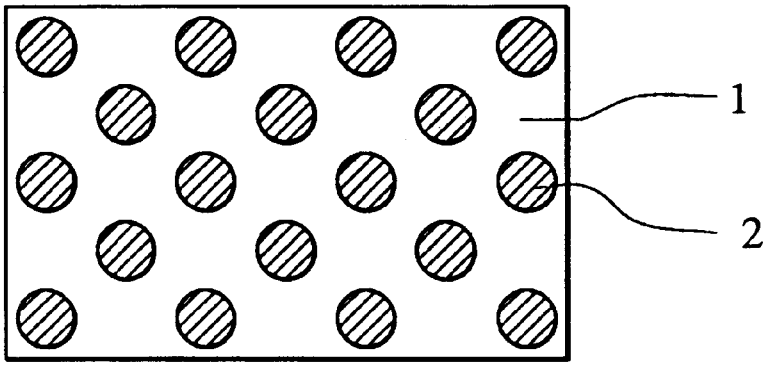
FIG. 1 shows one embodiment of the surface of the inkjet recording sheet of the present invention in which the ink impermeable layer has one ink impermeable section in a net shape.
Figure 2:
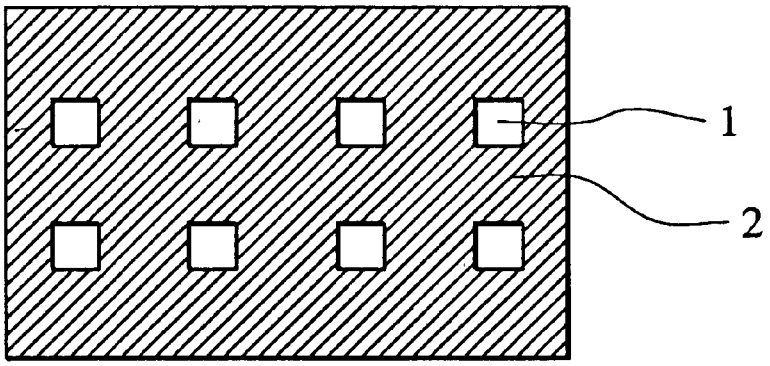
FIG. 2 shows another embodiment of the surface of the inkjet recording sheet of the present invention in which the ink impermeable layer has impermeable sections.
Figure 3:
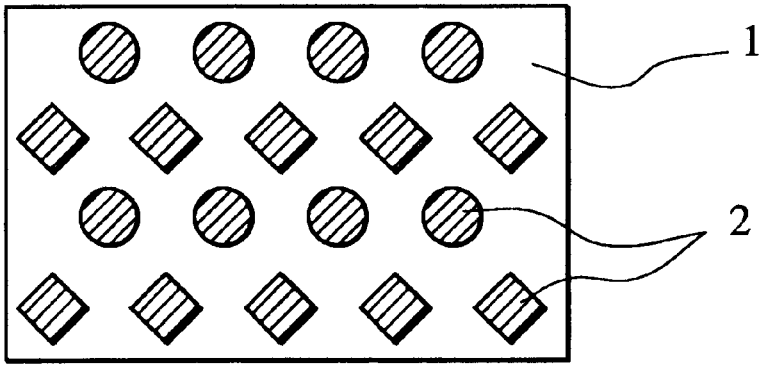
FIG. 3 shows another embodiment of the surface of the inkjet recording sheet of the present invention in which the ink impermeable layer has one ink impermeable section in a net shape.
Figure 4:
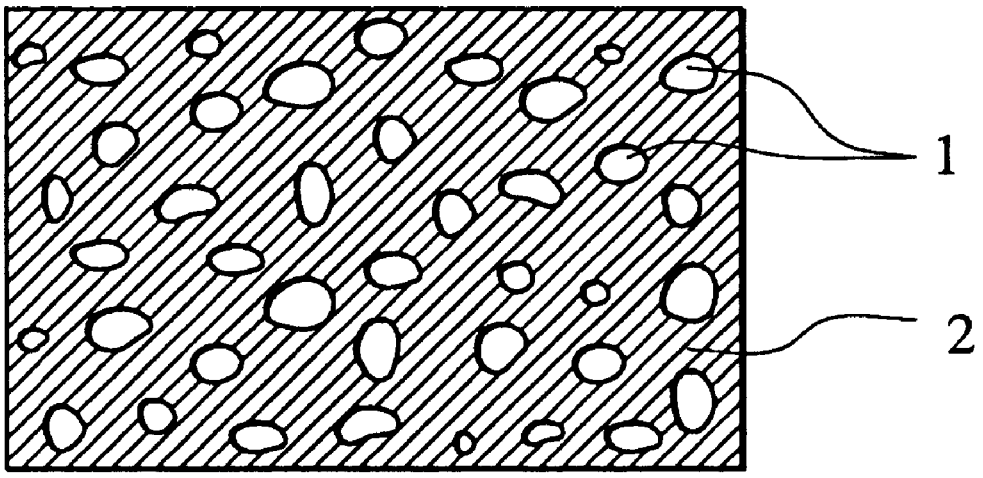
FIG. 4 shows another embodiment of the surface of the inkjet recording sheet of the present invention in which the ink impermeable layer has impermeable sections.
Figure 5:
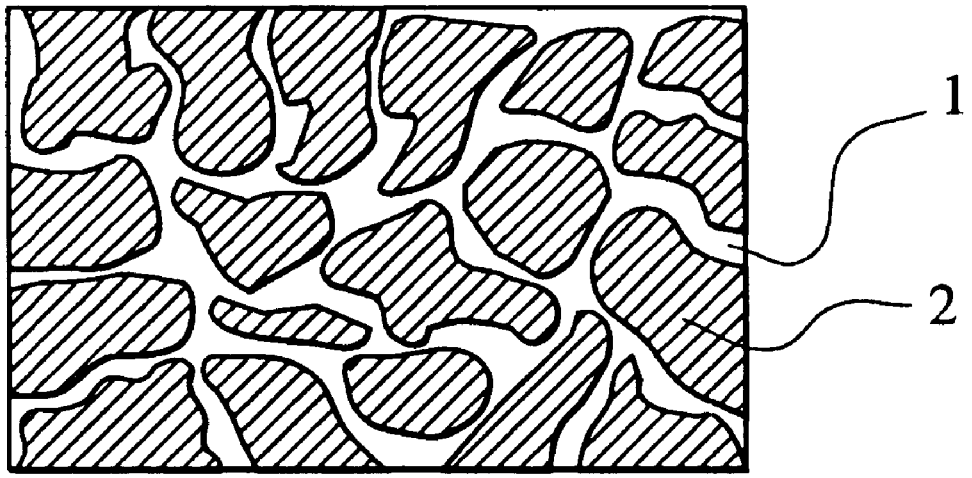
FIG. 5 shows another embodiment of the surface of the inkjet recording sheet of the present invention in which the ink impermeable layer has one ink impermeable section in a net shape.

A coating solution having the following composition was coated on the obtained ink absorbing layer 2, and then dried. Thereby, the inkjet recording sheet of this Example comprising the ink impermeable layer 1 as shown in FIG. 4 having a coating of 0.3 g/m$^2$ when dry was obtained.

| | |
|---|---|
| styrene-butadiene copolymer resin emulsion (trade name: LACSTAR DS-405; marketed by Dainippon Ink & Chemicals; solid percentages: 45%) | 10 parts |
| water | 200 parts |

It was confirmed using a microscope that the diameter of the ink impermeable sections are smaller than the diameter of the popular ink dot.

Example 2

The inkjet recording sheet of this Example was obtained in the same manner as Example 1, except that the solution for making an ink impermeable layer 1 was replaced with a solution having the following composition.

| | |
|---|---|
| styrene-butadiene copolymer resin emulsion (trade name: LACSTAR DS-405; marketed by Dainippon Ink & Chemicals; solid percentages: 45%) | 10 parts |
| water | 200 parts |
| colloidal silica (trade name: SNOWTEX UP; marketed by Nissin Chemical Industries, Ltd.; solid percentages: 20%) | 2 parts |

Example 3

The inkjet recording sheet of this Example was obtained in the same manner as Example 1, except that the solution for making an ink impermeable layer 1 was replaced with a solution having the following composition.

| | |
|---|---|
| acrylic resins emulsion (trade name: MOWINYL 767; marketed by Hoechst Synthesis Co., Ltd.; solid percentages: 45%) | 10 parts |
| water | 200 parts |

Example 4

The inkjet recording sheet of this Example was obtained in the same manner as Example 1, except that the solution for making an ink impermeable layer 1 was replaced with a solution having the following composition.

| | |
|---|---|
| acrylic resins emulsion (trade name: MOWINYL 767; marketed by Hoechst Synthesis Co., Ltd.; solid percentages: 45%) | 10 parts |
| water | 200 parts |
| colloidal silica (trade name: SNOWTEX UP; marketed by Nissan Chemical Industries, Ltd.; solid percentages: 20%) | 5 parts |

Example 5

The inkjet recording sheet of this Example was obtained in the same manner as Example 1, except that a coating solution for a glossed layer having the following composition was coated on the ink absorbing layer 2, polyester film having 25 $\mu$m thickness was put on the obtained glossed layer under moist conditions, the obtained layers were dried, polyester film was removed, thereby a glossed layer having a coating of 5 g/m$^2$ when dry was obtained, and the ink impermeable layer 1 was formed on the obtained glossed layer.

| | |
|---|---|
| colloidal silica (trade name: SNOWTEX UP; marketed by Nissan Chemical Industries, Ltd.; solid percentages: 20%) | 250 parts |
| polyvinyl alcohol denaturated with a carboxyl group (trade name: Gohsenol T-330; marketed by Nippon Synthetic Chemical Industry Co., Ltd.; 10% solution) | 50 parts |

Example 6

The inkjet recording sheet of this Example was obtained in the same manner as Example 5, except that the solution for making an ink Impermeable layer 1 was replaced with a solution for making an ink impermeable layer 1 used in Example 2.

Example 7

The inkjet recording sheet of this Example was obtained in the same manner as Example 3, except that the coating amount of the ink impermeable solution when dry was changed to 0.1 g/m$^2$.

Example 8

The inkjet recording sheet of this Example was obtained in the same manner as Example 3, except that the coating amount of the ink impermeable solution when dry was changed to 0.6 g/M$^2$.

Example 9

The inkjet recording sheet of this Example was obtained in the same manner as Example 3, except that the coating amount of the ink impermeable solution when dry was changed to 0.9 g/m$^2$.

Comparative Example 1

The inkjet recording sheet of this Example was obtained in the same manner as Example 1, except that an ink impermeable layer was not formed.

Comparative Example 2

The inkjet recording sheet of this Comparative Example was obtained in the same manner as Example 1, except that the solution for making the ink impermeable layer 1 was replaced with a solution having the following composition.

| | |
|---|---|
| denatured polyvinyl alcohol with a carboxyl group (trade name: Gohsenol T-330; marketed by Nippon Synthetic Chemical Industry Co., Ltd.; 10% solution) | 5 parts |
| water | 30 parts |

The inkjet recording sheets obtained in Examples 1 to 9, and Comparative Examples 1 to 2 were cut to A4 size. The following printing tests were carried out using the A4 size inkjet recording sheets which were printed with color using an inkjet printer (trade name: MJ-5000C; marketed by Seiko Epson Co., Ltd.) and an ink for inkjet printer (trade name: MJIC2C, marketed by Seiko Epson Co., Ltd.).

(1) Ink Absorption

After printing, the conditions of the ink which remained on the printed face as beads were evaluated by eye. Evaluation standards were as follows:

○: practically no remaining ink

×: remaining ink like beads

Δ: intermediate conditions between ○ and ×

(2) Color Development

The clearance, and the development of the samples after printing were evaluated by eye. Evaluation standards were as follows:

○: very good

×: inferior

Δ: intermediate conditions between ○ and ×

(3) Blurring

Reappearance of the printed dots was evaluated with a stereo-microscope (40 times). Evaluation standards were as follows:

○: shapes of dots being circular or nearly circular

×: blurring of dots was terrible, the shape of dots is irregular

Δ: intermediate conditions between ○ and ×

(4) Fixation

Immediately after printing, a paper was placed on the printed inkjet recording sheet, and rubbed the printed inkjet recording sheet rubbed through the paper. Then, the transferred condition of the ink to the paper was evaluated. Evaluation standards were as follows:

○: transcription of ink to paper cannot be confirmed

×: a large quantity of ink was transferred, fixation is very inferior

Δ: intermediate conditions between ○ and ×

(5) Anti-blocking properties 10 non-printed recording sheets of which an equilibrium moisture was controlled to 65% RH at 20° C., were piled, and left for 24 hours under the conditions of a weighting of 400 g/cm$^2$, and moisture of 90%RH at 40° C. Then, the weighting was removed, and the blocking conditions of the printed recording sheets were evaluated. Evaluation standards were as follows:

○: no blocking

×: blocking occurred

These test results were shown in Table 1.

TABLE 1

| | Ink Absorption | Color Development | Blurring | Fixation | Anti-blocking Properties |
|---|---|---|---|---|---|
| Example 1 | ○ | ○ | ○ | ○ | ○ |
| Example 2 | ○ | ○ | ○ | ○ | ○ |
| Example 3 | ○ | ○ | ○ | ○ | ○ |
| Example 4 | ○ | ○ | ○ | ○ | ○ |
| Example 5 | ○ | ○ | ○ | ○ | ○ |
| Example 6 | ○ | ○ | ○ | ○ | ○ |
| Example 7 | ○ | ○ | Δ | ○ | ○ |
| Example 8 | ○ | ○ | ○ | ○ | ○ |
| Example 9 | ○ | ○ | ○ | Δ | ○ |
| Comparative Example 1 | ○ | Δ | × | ○ | Δ |
| Comparative Example 2 | ○ | Δ | × | ○ | × |

As is clear from Table 1, the inkjet recording sheets of the Examples have good image properties such as color development, blurring, fixation property, and ink absorption, and excellent anti-blocking properties; therefore, they could provide fine full-color images. Moreover, in particular, an excellent appearance was obtained by the inkjet recording sheets in Examples 5 and 6.

In contrast, the inkjet recording sheets of the Comparative Examples have remarkable blurring, and inferior clearness of recorded images.

What is claimed is:

1. An inkjet recording sheet comprising an ink absorbing layer on at least one surface of a substrate, and an ink impermeable layer comprising a hydrophobic resin on the surface of the ink absorbing layer, wherein the ink impermeable layer is in the form of a net.

2. An inkjet recording sheet according to claim 1, wherein the ink impermeable layer is obtained by printing a pattern in the form of an ink impermeable section.

3. An inkjet recording sheet according to claim 1, wherein the ink impermeable layer is obtained by coating a solution for making an ink impermeable layer less than 1.0 g/m$^2$.

4. An inkjet recording sheet according to claim 1, wherein the ink impermeable layer comprises at least one hydrophobic resin selected from the group consisting of styrene-butadiene copolymer and styrene-acrylic copolymer.

5. An inkjet recording sheet according to claim 4, wherein said hydrophobic resin is an emulsion.

6. An inkjet recording sheet comprising an ink absorbing layer on at least one surface of a substrate, and an ink impermeable layer comprising a hydrophobic resin on the surface of the ink absorbing layer, wherein the ink impermeable layer contains at least one ink impermeable section in the form of a dot shape.

7. An inkjet recording sheet according to claim 6, wherein the ink impermeable layer contains two or more ink impermeable sections and the width of the ink impermeable sections is smaller than the diameter of an ink dot.

8. An inkjet recording sheet according to claim 6, wherein the ink impermeable layer is obtained by coating a solution for making an ink impermeable layer less than 1.0 $g/m^2$.

9. An inkjet recording sheet according to claim 2, wherein the ink impermeable layer comprises at least one hydrophobic resin selected from the group consisting of styrene-butadiene copolymer and styrene-acrylic copolymer.

10. An inkjet recording sheet according to claim 9, wherein said hydrophobic resin is an emulsion.

* * * * *